United States Patent [19]

Watkins

[11] Patent Number: 4,669,734

[45] Date of Patent: Jun. 2, 1987

[54] BOARD GAME UTILIZING JIGSAW PUZZLE

[76] Inventor: Kirk W. Watkins, 185 E. Parkwood Rd., Decatur, Ga. 30030

[21] Appl. No.: 699,685

[22] Filed: Feb. 8, 1985

[51] Int. Cl.[4] ..... A63F 9/10

[52] U.S. Cl. ..... 273/157 R

[58] Field of Search ..... 273/148 R, 157 R

[56] References Cited

U.S. PATENT DOCUMENTS

| | | | |
|---|---|---|---|
| 2,037,966 | 4/1936 | Dailey | 273/157 R |
| 2,073,551 | 3/1937 | Crasnoff | 273/148 R |
| 3,558,136 | 1/1971 | McFarland | 273/157 R X |
| 4,219,194 | 8/1980 | Powers | 273/157 R |

FOREIGN PATENT DOCUMENTS

| | | | |
|---|---|---|---|
| 83294 | 7/1983 | European Pat. Off. | 273/157 R |
| 2259632 | 8/1975 | France | 273/157 R |
| 553798 | 6/1943 | United Kingdom | 273/157 R |

OTHER PUBLICATIONS

Playthings, Mar. 1969, p. 87.

"Situation 4", Rules for Parker Brothers Action Puzzle Game, copyright 1968, Parker Brothers, Inc., Salem, Massachusetts.

*Primary Examiner*—Anton O. Oechsle

*Attorney, Agent, or Firm*—Jones & Askew

[57] ABSTRACT

A novel board game and method of playing the game are described in which pieces of a jigsaw puzzle are assembled over particular indicia of a game board. Points are assigned based on covering or connecting certain areas of the game board, and by playing a uniquely shaped piece of the puzzle in a particular manner. Score cards are assigned to players when points are earned, and totaled at the end of the game.

9 Claims, 6 Drawing Figures

10
14
16
25
28
27
34
35
36
29
31
SCORE CARDS
12

BOARD GAME UTILIZING JIGSAW PUZZLE

TECHNICAL FIELD

The present invention relates to board games and jigsaw puzzles, and more particularly relates to a board game in which pieces of a jigsaw puzzle are assembled by a player in ways which create scoring opportunities.

BACKGROUND ART

The assembly of jigsaw puzzles comprising many interlocking pieces to complete a design or picture on the face of the pieces as a pastime that has long been enjoyed by many people. However, no prior device is known which provides for the assembly of a jigsaw puzzle in connection with a game board so that the speed with which the puzzle is assembled and the strategy of how the puzzle is assembled cause various point values to be assigned to players.

SUMMARY OF THE INVENTION

Generally described, the present invention is a board game comprising a game board including indicia thereon defining an outline and a plurality of zones within the outline, and a jigsaw puzzle shaped to fit into the outline when the puzzle is assembled by a player. The jigsaw puzzle preferably comprises a plurality of conventional interlocking pieces together with at least one distinctly different piece that fits in with the other pieces. The puzzle is oriented with respect to the outline on the game board by providing a key indicia, a portion of which is placed on the game board and another portion of which is placed on one of the peripheral pieces of the puzzle. The puzzle is assembled to bring the portions of the key indicia into mating relationship to properly orient the puzzle.

The outline for the puzzle on the game board is preferably defined as a recess within the game board. The recess can be made by constructing the game board of two layers, a base layer, and a border layer laminated onto the base layer. A central opening corresponding to the outline is made in the border layer so that the puzzle pieces rest on the base layer but are retained within the central opening.

The base layer within the outline preferably includes indicia thereon which define a plurality of zones or scoring locations. Scoring occurs when the puzzle is assembled to cover certain zones, to connect the outline with certain points within the outline, and when the puzzle is completed. Points are also awarded for particular assembly of the pieces including the distinctly different piece.

The present invention further provides a method of playing a board game, comprising the steps of assembling a jigsaw puzzle comprising a plurality of interlocking pieces over a game board including indicia defining a plurality of zones on the game board, and assigning points to a player corresponding to coverage of predetermined portions of the zones by assembled pieces of the puzzle.

DETAILED DESCRIPTION OF THE PREFERRED EMBODIMENT

Figures 1, 2:
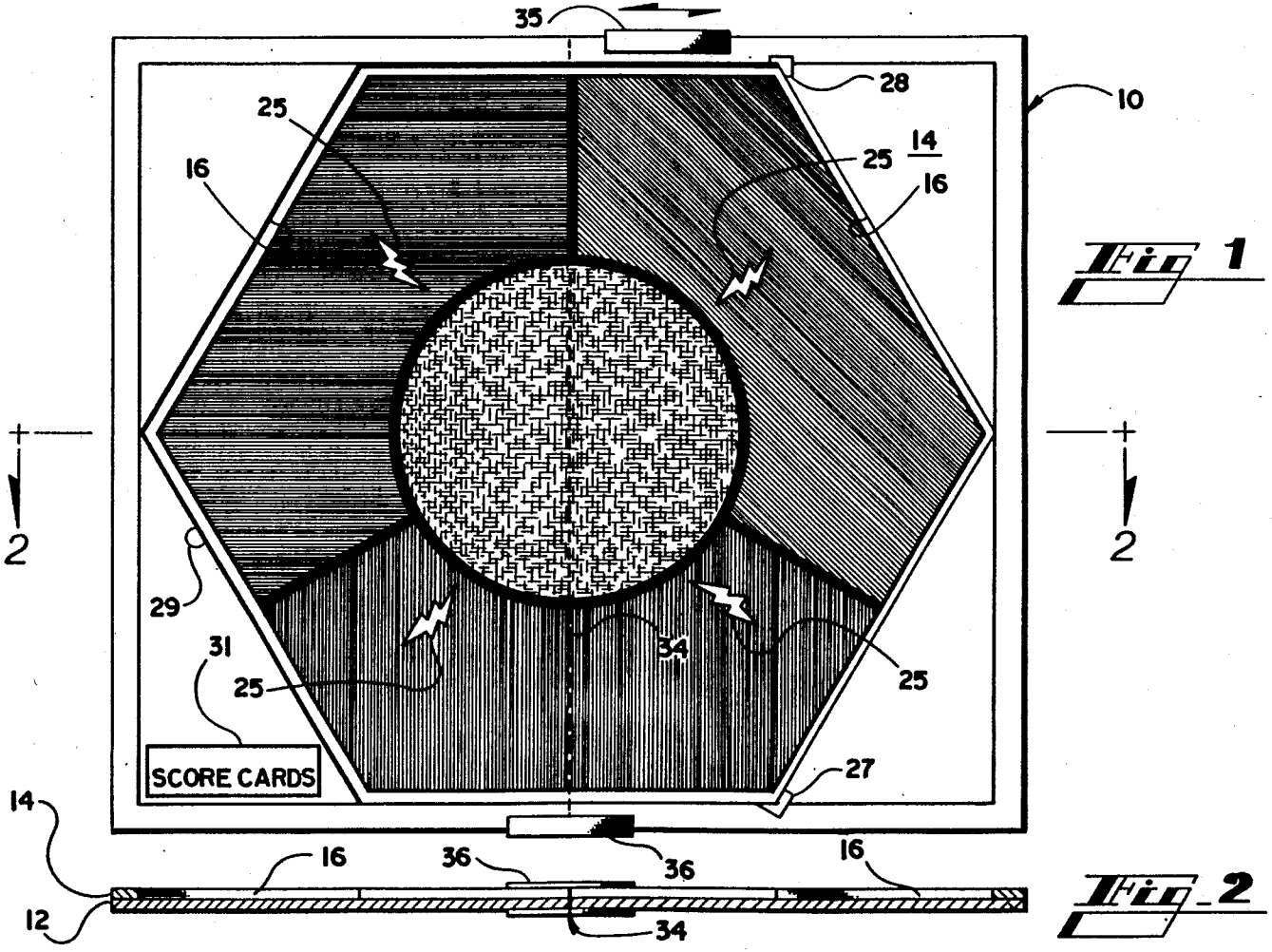
FIG. 1 shows a top plan view of a game board embodying the present invention.
FIG. 2 shows a vertical cross-sectional view of the game board taken along line 2—2 of FIG. 1.
Figures 3, 4, 5, 6:
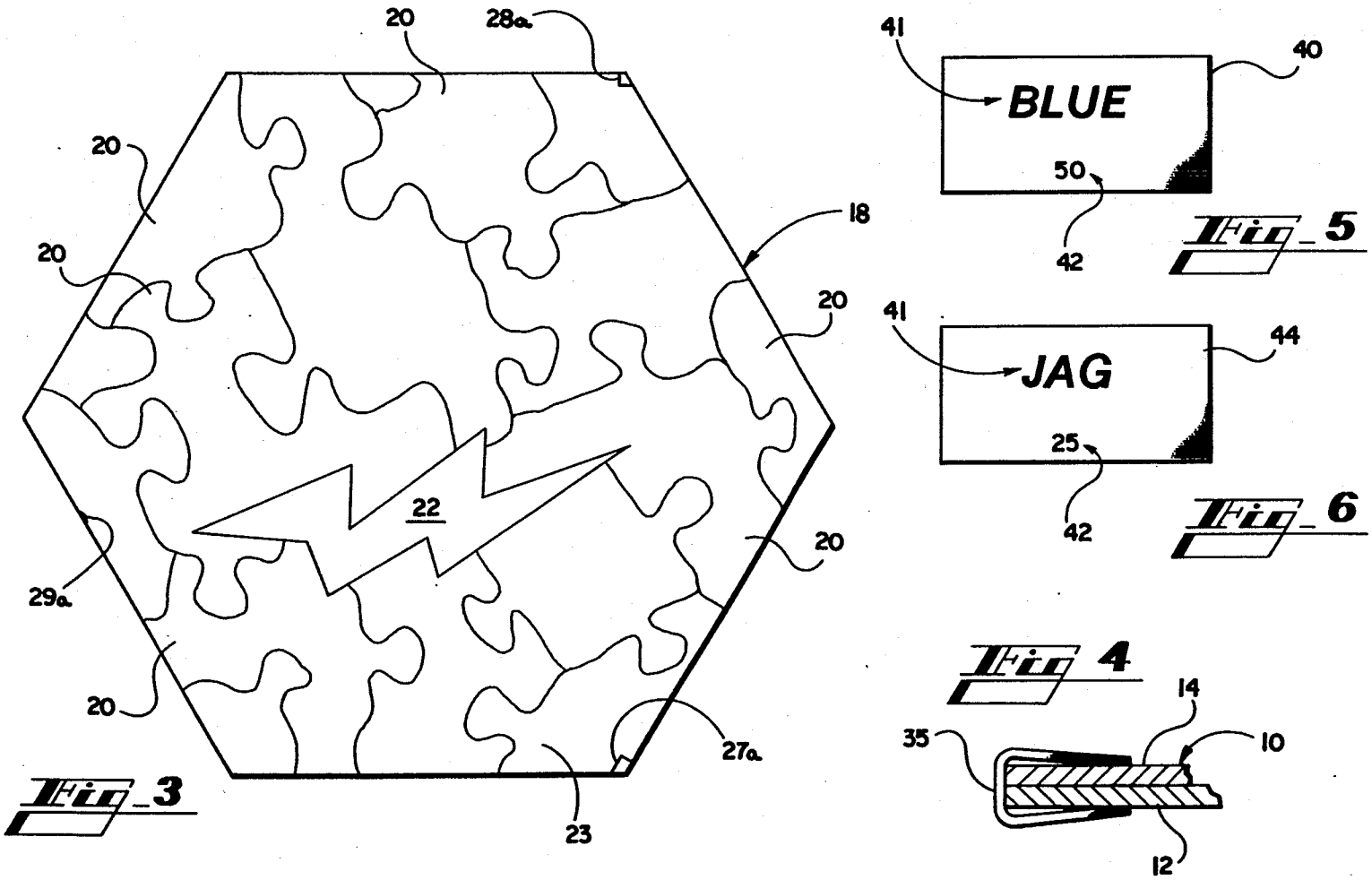
FIG. 3 shows a top plan view of a jigsaw puzzle that can be assembled on the game board shown in FIG. 1.
FIG. 4 shows a partial cross-sectional view of a locking clip used in connection with the game board of FIG. 1.
FIG. 5 is a plan view of a scoring card according to the invention.
FIG. 6 is a plan view of another scoring card according to the invention.

Referring now in more detail to the drawings, in which like numerals refer to like parts throughout the several views, FIG. 1 shows a top plan view of a game board 10 embodying the present invention. The game board is preferably constructed of a bottom layer 12 and a top or border layer 14, as shown best in FIG. 2. The top layer has defined therein a central opening 16, preferably in the shape of a hexagon. Within the recess created by the opening 16, the upper surface of the bottom layer 12 has indicia printed thereon defining distinctive zones within the opening 16. As shown, the zones are differentiated by their color, and are shown as a yellow central zone surrounded by a blue zone, a green zone and a red zone. When the top layer 14 is produced, the material removed to form the central opening 16 preferably forms a jigsaw puzzle 18 as shown in FIG. 3. When assembled, the puzzle 18 fits matingly within the opening 16 of the game board 10. The puzzle 18 comprises a plurality of conventional interlocking pieces 20, as well as a piece 22 having a distinctly different shape from the remainder of the interlocking pieces 20. The game board includes indicia 25 within the colored zones. Such indicia have a different color, such as white, from the colors of the zones, and preferably have a similar shape to the distinctly different puzzle piece 22.

In order to assure that the puzzle is correctly oriented with respect to the game board, key indicia are provided associated with each peripheral zone of the game board. When the border layer 14 and game board are printed, prior to die cutting the puzzle from the center of the border layer 14, the key indicia are printed within each zone overlapping a puzzle piece and the adjoining border area. For example, a hexagonal key indicia 27 has a first portion printed on the game board, and the remaining portion of the hexagon printed on puzzle piece 23. Similarly, key indicia 28 is in the form of a square, with one portion of the square printed on the game board, and the remaining portion **28*a* of the square printed on a puzzle piece. Similarly, in another zone, the portion of a circle 29 printed on the game board is completed by the remaining portion of the circle 29*a* on a puzzle piece. It will be seen that when the puzzle is assembled with the pieces bearing the key indicia portions 27*a*, 28*a* and 29*a* placed in mating relationship with the corresponding portions of key indicia 27, 28 and 29**, the puzzle will be oriented in a particular relationship to the game board.

An indicia 31 is placed on the game board 10 to provide a location for score cards won by a player. A pair of score cards is shown in FIGS. 5 and 6. FIG. 5 shows a score card 40 which includes an indicia 41 indicating which portion of the game board has been covered or reached by pieces of the jigsaw puzzle 18. Another indicia 42 is included on the card 40 to show points won. FIG. 6 shows a score card 44 having similar indicia 41 and indicia 42. Score card 40 would be drawn when the blue zone has been covered by pieces 20 of the puzzle. Score card 44 would be drawn when one of the indicia 25 of the game board has been connected by puzzle pieces to the outline of the central opening 16 of the game board. Many other scoring possibilities are provided, as described below.

The game board is provided with a central score 34 (shown in dotted lines in FIG. 1). The board can be folded about the score 34 for packaging and storage. In order to prevent the board from folding when puzzle pieces are present on the board, a pair of flexible plastic clips 35 and 36 are provided in sliding relationship along the edged of the board. The clip 35 in FIG. 1 is shown moved away from the score 34, so that the board can be folded when both clips are in this position. A clip 36 is shown in locking position, wherein the board is prevented from folding. The clips 35 and 36 can be constructed in the manner in which "backbone" clips are formed for removably binding loose leaf sheets together, often within transparent plastic covers.

The game of the present invention can be played competitively by persons of all ages. The primary objective of the game is to assemble the puzzle pieces faster than an opponent assembles his own puzzle. Thus, when played competitively, each player or team has a separate game board and puzzle. During assembly of the puzzle pieces, particular coverage of the game board gives rise to various scoring events. Upon scoring, the player draws the appropriate score card to be saved and totaled when the game is completed.

Each player's objective is to obtain the highest number of points before the game ends, which occurs when the first player completes his or her puzzle. Points are scored as each player (or team) assembles their separate jigsaw puzzle on their separate board. To win score cards, portions of the board must be covered with puzzle pieces. The following occurrences entitle a player to a particular score card:

(1) One type of score card is awarded when a portion of the outline of the central opening 16 is completed. This can occur, for example, when one of the six hexagonal sides has connected puzzle pieces lying completely along it.

(2) The complete covering of a color zone on the board entitles a player to another appropriate score card.

(3) Another type of score card is obtained when a player connects puzzle pieces from the outline of the opening 16 to touch one of the special indicia 25 on the board.

(4) Another type of score card is won by connecting puzzle pieces including the distinctly different piece 22 to the outline of the playing opening. (5) Another score card is obtained when the entire puzzle is completed.

As indicated above, each score card signifies how many points it is worth. The score cards are arranged so that the first player to complete one of the categories receives the highest possible point total for that category. The next player to receive a score card for that category receives a lower point total. In this way, speed of assembly of the puzzle is rewarded, and the players can exercise strategy decisions to determine which categories to pursue first on account of the speed with which they think the category can be accomplished and the number of points it is worth.

The skill level required to play the game according to the invention can be varied greatly by providing many different puzzles that will fit within the opening in the game board. One skill factor is the number of pieces in the puzzle. Another skill factor is the nature of the graphic design on the puzzle, since, for example, detailed patterns may be easy to match, but solid color areas are harder. By providing a range of skill levels, adults can compete directly with children while still exerting their best efforts on a harder puzzle.

The hexagonal shape of the puzzle lends itself readily to puzzle variations, because a new puzzle can be created by rotating the die through increments of 60 degrees about the center of the puzzle.

The method of playing the game can be modified in many ways. A progressive version of the game requires players to play a series of games with the number of puzzle pieces in the puzzle increasing with each game until a set number of points is accumulated. Speed can be emphasized by using games with smaller numbers of pieces. A single player can play the game by assembling as much of a puzzle as possible while accumulating points during a set period of time. For example, the player can accumulate cards for the first ten minutes and place them in one stack, accumulate cards for the next ten minutes in another stack, and so on. The point totals gained in the early going can then be weighted more heavily than the points earned later on. Bonus points can be awarded if the entire puzzle is completed in less than a fixed amount of time. The player can try to improve his score in later attempts.

While this invention has been described with particular reference to a preferred embodiment thereof, it will be understood that variations and modifications can be made without departing from the spirit and scope of the invention as defined in the appended claims.

I claim:

1. A board game comprising:

first and second corresponding game boards each including indicia thereon defining an outline and a plurality of corresponding zones within said outline;

first and second jigsaw puzzles shaped to fit when assembled by first and second players, into said outline; said puzzles comprising a plurality of interlocking pieces, said pieces of said first puzzle being substantially more difficult to assemble than the pieces of said second puzzle;

so that players of substantially different abilities can play the game competitively; and a plurality of sets of cards each of said sets bearing a first indicia corresponding to one of said zones and a second indicia corresponding to a range of score values, such that when assembly of one of said puzzles has progressed to a predetermined relationship with said one of said zones, the corresponding card can be chosen by said player assembling said puzzle.

2. The board game of claim 1, wherein said first and second game boards each comprise:

a base layer; and a border layer laminated onto said base layer, said border layer circumferentially surrounding and defining a central opening corresponding to said outline, such that one of said puzzles is retained within said opening so as to cover said corresponding zones.

3. A board game comprising:

first and second corresponding game boards each including indicia thereon defining an outline and a plurality of corresponding zones within said outline;

first and second jigsaw puzzles comprising a plurality of interlocking pieces, said pieces shaped to fit, when assembled by first and second players, into said outline so as to cocver said zones; and a plurality of sets of cards, each card of each of said sets bearing a zone indicia corresponding to a single pair of said corresponding zones, and a score indicia differing in value from the other cards of said set;

whereby the first of said players to cover one of said zones with puzzle pieces can receive the card having the highest score indicia of the set of cards bearing the zone indicia of said covered zone.

4. The board game of claim 3, wherein said first and second game boards each comprise:

a base layer; and a border layer laminated onto said base layer, said border layer circumferentially surrounding and defining a central opening corresponding to said outline, such that one of said puzzles is retained within said opening so as to cover said corresponding zones.

5. A method of playing a game, comprising the steps of:

each of a plurality of players assembling a corresponding plurality of jigsaw puzzles, comprising interlocking pieces, over corresponding game boards, said game boards including indicia defining a plurality of zones /on said game boards;

assigning a point value to one of said players who first covers a predetermined portion of said zones with assembled pieces of said jigsaw puzzle; and assigning a lower point value to another of said players who subsequently covers said predetermined portion of said zones with assembled pieces of said jigsaw puzzle.

6. The method of claim 5, wherein said predetermined portion of said zones comprises a portion of an outer periphery of said puzzle.

7. The method of claim 5, wherein said predetermined portion of said zones comprises the complete area of one of said zones.

8. The method of claim 5, further comprising:

assigning a point value to one of said players who first plays a particular one of said pieces; and assigning a lower point value to another of said players who subsequently plays said particular piece.

9. The method of claim 5, wherein said puzzles corresponding to said players vary in difficulty.

* * * * *